US007946447B2

(12) United States Patent
Toth et al.

(10) Patent No.: US 7,946,447 B2
(45) Date of Patent: May 24, 2011

(54) METHOD OF SELLING DOSAGE FORMS WITHOUT A PRESCRIPTION

(75) Inventors: Mary Toth, Ann Arbor, MI (US); Javier Verdura, Milford, CT (US); Craig Pirie, Ontario (CA); Daniel Peter Sterling, Bridgeport, CT (US); Erik Joseph Moses, New Haven, CT (US); Peter Michaelian, New York, NY (US); Richard A. Gross, Oconomowoc, WI (US); Dieter F. Lay, Oconomowoc, WI (US); Roger Rinker, Hatfield, PA (US); Kristin Recchiuti, North Wales, PA (US); Leonard Wojnarowicz, Jr., Willow Grove, PA (US); John Spano, Bordentown, NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 416 days.

(21) Appl. No.: 12/034,763

(22) Filed: Feb. 21, 2008

(65) Prior Publication Data

US 2009/0057187 A1 Mar. 5, 2009

Related U.S. Application Data

(62) Division of application No. 11/018,051, filed on Dec. 21, 2004, now Pat. No. 7,370,773.

(51) Int. Cl.
*B65D 25/54* (2006.01)

(52) U.S. Cl. ..... 220/662

(58) Field of Classification Search ..... 220/662, 220/602, 675, 669, 23.83, 663, 380, 660, 220/600; 215/365, 382, DIG. 3, 10, 376, 215/370, 379; 206/540, 528, 534, 509, 508, 206/507, 505, 504, 769, 771, 538, 539, 776, 781; D9/530, 567, 516, 523
See application file for complete search history.

(56) References Cited

U.S. PATENT DOCUMENTS

| | | | | |
|---|---|---|---|---|
| 236,997 | A * | 1/1881 | Dodge | 222/456 |
| 353,600 | A * | 11/1886 | Sloan | 215/10 |
| 1,994,063 | A | 3/1935 | Bruns et al. | |
| 2,299,277 | A * | 10/1942 | Neuschaefer | 434/100 |
| 2,362,609 | A | 11/1944 | Blackman | |
| 2,578,444 | A * | 12/1951 | Nicolle | 206/461 |
| 2,692,698 | A | 10/1954 | Waterman | |
| 2,722,309 | A | 11/1955 | Waterman | |
| D189,834 | S | 2/1961 | Yoshimoto | |
| 3,001,564 | A | 9/1961 | Hopkins | |

(Continued)

FOREIGN PATENT DOCUMENTS

| | | |
|---|---|---|
| GB | 3019104 | 10/2004 |

*Primary Examiner* — Anthony Stashick
*Assistant Examiner* — Robert J Hicks
(74) *Attorney, Agent, or Firm* — Karen G. Horowitz

(57) ABSTRACT

The invention features a method of selling dosage forms without a prescription. In accordance with one aspect of the invention, the dosage forms are sold in a container displayed on a retail shelf without outer secondary packaging. The container preferably is made of a material through which the dosage forms are visible. In accordance with another aspect of the invention, the container has at least one substantially flat side wall and is laid on a retail display shelf on its substantially flat side wall. The container may be formed to have only one plane of symmetry. At least one of the side walls of the container may be formed to facilitate gripping of the container.

20 Claims, 16 Drawing Sheets

U.S. PATENT DOCUMENTS 3,059,762 A 10/1962 Yoshimoto
D194,071 S 11/1962 Anderson et al.
3,322,262 A * 5/1967 Puente ..... 206/398
D216,460 S 1/1970 Gibson
D220,246 S 3/1971 Pacelli et al.
3,623,634 A 11/1971 Norgard
3,749,230 A 7/1973 Foster
3,845,872 A 11/1974 Towns et al.
3,863,804 A 2/1975 Infante-Diaz et al.
3,872,996 A 3/1975 Dogliotti
3,907,103 A 9/1975 Shaw
3,964,609 A 6/1976 Perrella
4,081,128 A 3/1978 O'Neill
4,095,712 A 6/1978 Perrella
D250,171 S 11/1978 Yoshimoto
D255,325 S 6/1980 Hoyt
4,223,814 A 9/1980 Sneider
4,238,033 A * 12/1980 Artzt ..... 206/534
D262,264 S 12/1981 Hadtke et al.
D262,265 S 12/1981 Hadtke et al.
D264,127 S 4/1982 Peterson
D264,179 S 5/1982 Dash
D266,095 S 9/1982 Hara
4,354,619 A 10/1982 Wippermann et al.
4,378,885 A 4/1983 Leopoldi et al.
D270,998 S 10/1983 Stark
D272,419 S 1/1984 Persch
D273,563 S 4/1984 Jeans et al.
4,462,501 A 7/1984 Franchi
D277,363 S 1/1985 Drummond et al.
4,535,903 A 8/1985 Franchi
4,579,260 A * 4/1986 Young et al. ..... 222/465.1
4,640,423 A * 2/1987 Mednis ..... 215/10
D295,021 S 4/1988 Logsdon
4,770,854 A * 9/1988 Lyman ..... 422/556
4,796,802 A 1/1989 Reil
4,807,768 A 2/1989 Gach
4,838,441 A 6/1989 Chernack
4,872,559 A * 10/1989 Schoon ..... 206/538
D308,480 S 6/1990 Hoyt
D309,080 S 7/1990 Buchholz
4,940,167 A 7/1990 Fillmore et al.
5,002,199 A * 3/1991 Frahm ..... 220/670
D317,719 S * 6/1991 Hestehave et al. ..... D9/523
5,082,114 A 1/1992 Bunin
D328,431 S 8/1992 Skidmore et al.
5,163,559 A 11/1992 Bunin
D333,096 S 2/1993 Binder
D334,795 S 4/1993 Demarest
D337,052 S 7/1993 Anderson
5,255,786 A 10/1993 McQuay
D341,778 S 11/1993 D'Amico et al.
D344,889 S 3/1994 Kozlowski et al.
D346,962 S 5/1994 Steijns et al.
D347,479 S 5/1994 Hansen et al.
5,312,011 A 5/1994 Fischer
D349,644 S 8/1994 Miyairi et al.
5,346,069 A 9/1994 Intini
5,346,086 A 9/1994 Harris
D355,125 S 2/1995 Patel et al.
D355,126 S 2/1995 Paulovich et al.
D356,504 S 3/1995 Saltz
D364,344 S 11/1995 Shaw
5,503,284 A * 4/1996 Li ..... 215/383
5,573,127 A 11/1996 Takahashi et al.
5,575,399 A 11/1996 Intini
5,579,957 A 12/1996 Gentile et al.
D384,882 S * 10/1997 Tabaroni et al. ..... D9/696
D386,967 S 12/1997 Alarcon
5,718,347 A 2/1998 Walker et al.
D392,892 S 3/1998 Meyers et al.
D397,247 S 8/1998 Gardner et al.
5,788,064 A 8/1998 Sacherer et al.
5,860,543 A 1/1999 Decelles
5,887,736 A 3/1999 Mar
5,927,535 A 7/1999 Goth
6,095,364 A 8/2000 Dickie et al.
D431,458 S 10/2000 Bried et al.
6,168,039 B1 * 1/2001 Schwaikert ..... 220/23.83
6,253,938 B1 7/2001 Zaksenberg et al.
D454,063 S 3/2002 Dammers
D454,302 S 3/2002 Dammers
D454,308 S 3/2002 Scheida
D466,012 S 11/2002 Baker
D466,815 S 12/2002 Sweeton
D470,765 S 2/2003 Baker
6,561,391 B1 5/2003 Baker
D477,536 S 7/2003 Kudo et al.
D485,187 S 1/2004 Stinedurf
6,681,945 B1 1/2004 Harrold
D486,396 S 2/2004 Stinedurf
D489,003 S 4/2004 Loth
6,732,873 B2 5/2004 Bried et al.
6,742,666 B1 6/2004 Bried et al.
6,772,894 B1 8/2004 Druitt et al.
6,772,902 B1 8/2004 White
D506,392 S 6/2005 Dedancourt
2003/0159965 A1 8/2003 Baker et al.
2004/0065669 A1 * 4/2004 Giraud et al. ..... 220/839
2005/0006420 A1 * 1/2005 Lo ..... 222/564
2006/0272638 A1 * 12/2006 Brickl et al. ..... 128/203.15

* cited by examiner

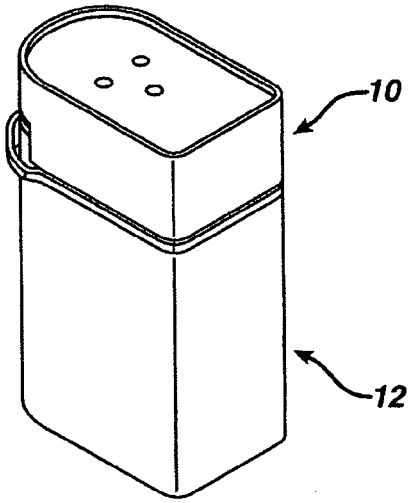
FIG. 1
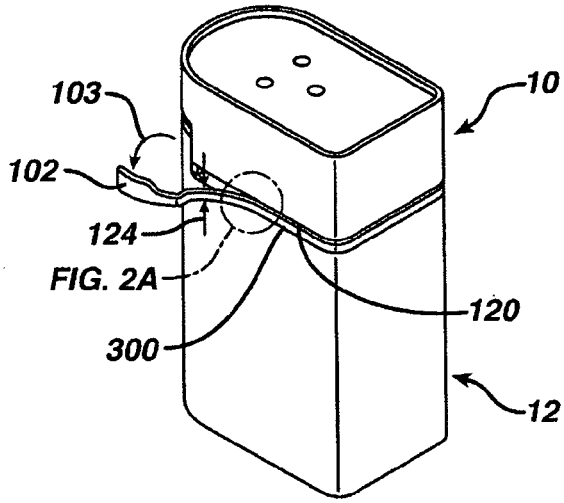
FIG. 2
FIG. 2A
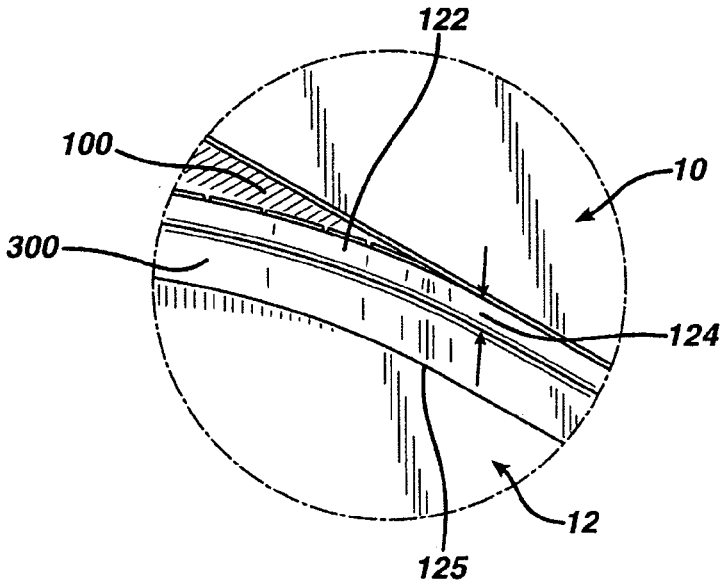

METHOD OF SELLING DOSAGE FORMS WITHOUT A PRESCRIPTION

CROSS REFERENCE TO RELATED APPLICATIONS

This is a divisional of prior U.S. application Ser. No. 11/018,051, filed Dec. 21, 2004, now U.S. Pat. No. 7,370,733 which is incorporated by reference in its entirety herein

FIELD OF THE INVENTION

This invention relates to child-resistant closures for dispensing containers, such as those for dispensing pharmaceuticals, and more specifically to non-round containers.

BACKGROUND OF THE INVENTION

There is an increasing awareness of the requirement to protect children from inadvertently gaining access to pharmaceutical medications. However, this requirement is often balanced with the necessity to provide containers for medications that may otherwise may be readily and easily opened by an adult, i.e., any person having the cognitive ability to understand the instructions for opening a container requiring a certain manipulation and manual dexterity. Such persons are assumed, as well, to have the ability to understand that opening a container to gain access to the medication therein is a deliberate action, and is only undertaken when there is a necessity to attain access to the pharmaceutical medication contained therein.

Often, such adults have the sufficient manual dexterity to open a container, but may suffer from a debilitating condition such as arthritis. Such persons may still desire to have their medications in containers that require specific manipulation and manual dexterity, and thus child-resistance, but with lesser physical effort.

There are several well-known child-resistant containers in the market that are capable of dispensing one or a plurality of dosage forms such as tablets, gel-caps, capsules, or the like. They include the so-called "arrow-alignment" closures or the "push-and-turn" closures. In both cases, the containers are of the standard cylindrical variety.

The push-and-turn systems require that the closure be pushed axially downwardly and rotated at the same time. Disadvantageously, very considerable force, which is often beyond that which can easily be exerted by arthritic patients, may be required. Moreover, the specific force required between two otherwise identical, push-and-turn closures and containers, often differs from one to the other.

A user of closures having the arrow-alignment systems often needs to have relatively good eyesight in order to properly align an arrow on the closure or cap with an arrow typically embossed on the container. Even after the arrows are aligned, a user may still need to exert a very considerable force to push up the cap away from the container, so as to remove the cap, which also may be difficult for an arthritic patient.

Currently produced pharmaceutical containers tend to be cylindrical in shape and not very space efficient. These containers may not be easily stacked except in an end-to-end fashion, and even then only precariously. Moreover, placement of a number of cylindrical pharmaceutical containers together on a shelf results in an inefficient use of the volume in which they are placed due to the spaces left between the curved cylindrical walls. In order to improve storage efficiency, such containers are often packed in an outer rectangular paper packaging; however, the inclusion of such outer packaging is not only economically undesirable, but it also increases the production cycle time. Still further, it is also often difficult to read the label directions for pharmaceuticals contained in a cylindrical pill container due to the continual need to turn or rotate the cylindrical container.

Another disadvantage associated with closures suitable for cylindrical tablet containers is that the closure becomes physically separated from the container upon opening. The closure may then either become lost, or in the event where multiple medications are being dispensed, may inadvertently be secured incorrectly or loosely secured onto the wrong container. Still further, there is also a risk that children may place the separated cap into their mouth, which might result in choking.

One approach to overcoming such disadvantages is disclosed in U.S. Pat. No. 6,095,364, which discloses a unitary child-resistant closure having a rectangular base and a hinge connecting a moveable closure member to an end wall of the base. Such closures are suitable for use in rectangular containers. Disadvantageously, the hinge may break due to stresses associated with repetitive openings and closings. Also, this type of dosage form relies upon the use of only one finger for its operation, which still may cause difficulties for those suffering from arthritis.

Consumers of ingestible goods, such as nutraceutical or pharmaceutical medications also may wish to be assured in their own minds that the container of such goods has not been tampered with in the interval after the container left the manufacturing facility.

It would be desirable to have a child-resistant closure that is suitable for use in both cylindrical and non-cylindrical shaped containers, that is not easily removed from its container, and that may be opened by adults who may have compromised hand strength.

SUMMARY OF THE INVENTION

In accordance with the present invention, there is provided a child-resistant closure for containers, and a combination of a child-resistant closure together with a container and an optional tamper-evident means as disclosed in the claims.

In one aspect, the invention features a child resistant, moveable closure member and container device comprising:

a) an overcap having opposed first and second end walls, opposed first and second sidewalls, an upper surface and a lower surface opposite thereto, at least one leading locking pin in at least one of said sidewalls proximate to the second end wall, and at least one trailing locking pin in at least one of said sidewalls distal to the second end wall;

b) an inner closure having a front end and an opposed back end, a first major closure surface and second major closure surface opposite thereto, said first major closure surface facing the lower surface of the overcap, said inner closure and said overcap forming a moveable closure member;

c) a container having a hollow body, a portion of said hollow body being an upper body adjacent to a fixed cover portion, said upper body having a container footprint with opposed first and second container end walls, and opposed first and second container side walls, said fixed cover portion facing the second major closure surface and having a dispensing opening therethrough proximate to the second container end;

wherein at least one of said sidewalls of the upper body has a closing notch proximate to the second container end wall, a stopping notch distal to the second container end wall and proximate to the first container endwall, and an opening notch therebetween;

wherein at least one of the leading locking pins is removably engaged in one of the closing notches and at least one of the trailing locking pins is removably engaged in at least one of the open notches when the overcap is in the its operative closure position;

wherein, when the moveable closure member is in its operative open position, at least one of the leading locking pins is removably engaged in one of the open notches and at least one of the trailing locking pins is removably engaged in one of the stopping notches.

In another aspect, the invention features an overcap and container device comprising:

a) an overcap having opposed first and second end walls, opposed first and second sidewalls, an upper surface and a lower surface opposite thereto, at least one leading locking pin in each sidewall proximate to the first end wall, and at least one trailing locking pin in each sidewall distal to the first end wall;

b) a container having a hollow body, a portion of said hollow body being an upper body adjacent to a fixed cover portion, said upper body having a container footprint with opposed first and second container end walls, and opposed first and second container side walls, said fixed cover portion facing the lower surface of the overcap, and having a dispensing opening therethrough and proximate to the second container end;

wherein each sidewall of the upper body has at least one closing notch proximate to the second container end wall, and a stopping notch distal to the second container end wall and proximate to the first container end wall;

wherein at least one of the leading locking pins is removably engaged in at least one of the closing notches when the overcap is in the its operative closure position;

wherein, when the moveable closure member is in its operative open position, at least one of the trailing locking pins is removably engaged in at least one of the stopping notches.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which an embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which:

FIG. 1 is a perspective view of a child-resistant closure of the present invention when placed on a container, as shown in the closed position prior to removal of the tamper evident band;

FIG. 2 is a perspective view of the child-resistant closure and container of FIG. 1, wherein the tamper evident band is in the process of being removed;

FIG. 2A is an enlarged perspective view of a portion of the tamper evident band on the container of FIG. 2 while it is in the process of being removed.

FIG. 15 A is an enlarged side elevational view of the assembled child-resistant closure and container of FIG. 15.

FIG. 16 A is an enlarged cross-sectional view of the assembled child-resistant closure and container of FIG. 16.

DETAILED DESCRIPTION OF THE PREFERRED EMBODIMENTS

Figure 3:
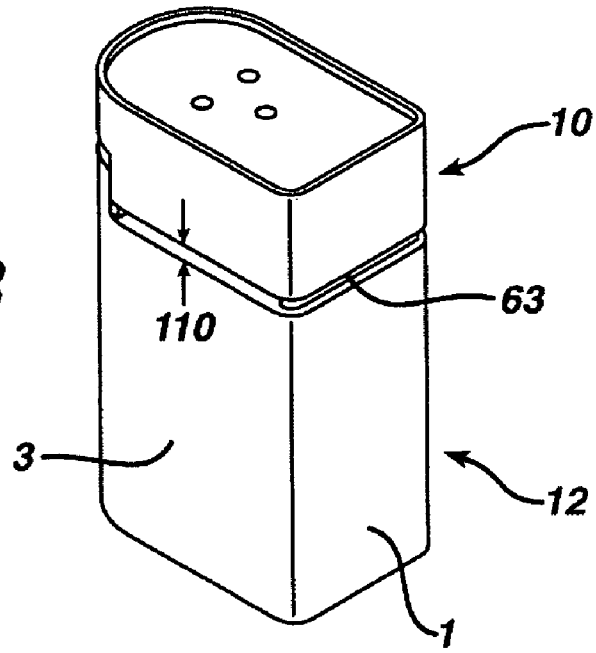
FIG. 3 is a perspective view of the child-resistant closure and container of FIG. 1 after the tamper evident band has been removed.
Figure 4:
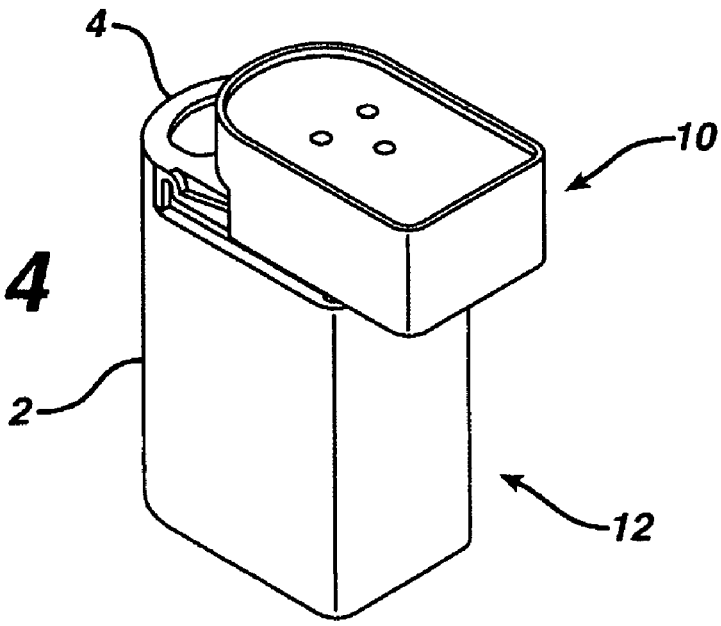
FIG. 4 is a perspective view of the child-resistant closure and container of FIG. 3 with the closure being displaced so as to partially expose the dispensing opening in the container.

Unless defined otherwise, all technical and scientific terms used herein have the same meaning as commonly understood by one of ordinary skill in the art to which the invention belongs. Also, all publications, patent applications, patents, websites, and other references mentioned herein are incorporated by reference.

As used herein, "child-resistant" shall mean that, when the package is tested by a group which comprises children, the container cannot be opened by at least about 85% of those children prior to a demonstration to them as to the proper means of opening the package; but still cannot be opened by at least about 80% of those children after the demonstration to them of the proper means for opening the package. In the case where a child-resistant package is provided to a test group of adults, it must be capable of being opened by at least about 90% of those adults; and, where the package is designed so that it may be re-closed, it can be re-closed by at least about 90% of those adults but still cannot be opened by at least about 85% of children to whom no demonstration as the proper method of opening the package has been given, nor by about 80% of those children after a demonstration has been made.

Moreover, throughout the present disclosure, the use of the word "tablet" in describing a tablet container or any pharmaceutical medication which may be placed in the container is meant to refer to any particulate prescribed medications of the sort generally embodied by tablets, pills, caplets, capsules, gel-caps, or and the like. Any such medications are prescribed and dispensed by numbers of units—for example, administrative instructions may require the oral consumption of two tablets daily for a period not to exceed one week would mean that not more than 14 tablets be dispensed.

As used herein, the term "dosage form" applies to any ingestible forms, including pharmaceuticals, nutraceuticals, as well as confections.

In one embodiment, dosage forms are solid, semi-solid, or liquid compositions designed to contain a specific pre-determined amount (i.e. dose) of a certain ingredient, for example an active ingredient as defined below. Suitable dosage forms may be pharmaceutical drug delivery systems, including those for oral administration, buccal administration, rectal administration, topical, transdermal, or mucosal delivery, or subcutaneous implants, or other implanted drug delivery systems; or compositions for delivering minerals, vitamins and other nutraceuticals, oral care agents, flavorants, and the like. In one embodiment, the dosage forms of the present invention are considered to be solid; however, they may contain liquid or semi-solid components. In another embodiment, the dosage form is an orally administered system for delivering a pharmaceutical active ingredient to the gastro-intestinal tract of a human. In yet another embodiment, the dosage form is an orally administered "placebo" system containing pharmaceutically inactive ingredients, and the dosage form is designed to have the same appearance as a particular pharmaceutically active dosage form, such as may be used for control purposes in clinical studies to test, for example, the safety and efficacy of a particular pharmaceutically active ingredient.

"Active ingredients," as used herein, includes, for example, pharmaceuticals, minerals, vitamins and other nutraceuticals, oral care agents, flavorants and mixtures thereof. Suitable pharmaceuticals include, but are not limited to, analgesics, anti-inflammatory agents, antiarthritics, anesthetics, antihistamines, antitussives, antibiotics, anti-infective agents, antivirals, anticoagulants, antidepressants, antidiabetic agents, antiemetics, antiflatulents, antifungals, antispasmodics, appetite suppressants, bronchodilators, cardiovascular agents, central nervous system agents, central nervous system stimulants, decongestants, diuretics, expectorants, gastrointestinal agents, migraine preparations, motion sickness products, mucolytics, muscle relaxants, osteoporosis preparations, polydimethylsiloxanes, respiratory agents, sleep-aids, urinary tract agents and mixtures thereof.

The child-resistant closure is shown generally at 10; a container is shown generally at 12. Although not shown, the size of the container 12 may vary, depending on the volume which is required. For example, a container into which thirty tablets might be dispensed may have a general appearance such as that shown in FIG. 1, whereas a container into which ninety tablets will be dispensed would be considerably larger.

Unlike the containers used with prior art child-resistant closures, the shape of the containers that are suitable for use in the present invention is not critical. Referring particularly to, for example, FIGS. 1 through 5, a container 12 having a first flat end 1, a second curved end 2 opposite therefrom, and a pair of flat side walls 3, 4 is shown for illustration purposes only. However, when aesthetics is of particular concern, the "footprint" formed by the end walls 1, 2 and side walls 3, 4 of the container 12, and in particular the footprint of the upper body portion 180 preferably resembles the footprint formed by the end walls 14, 15 and side walls 16, 17, respectively, of the overcap 11.

Figure 29:
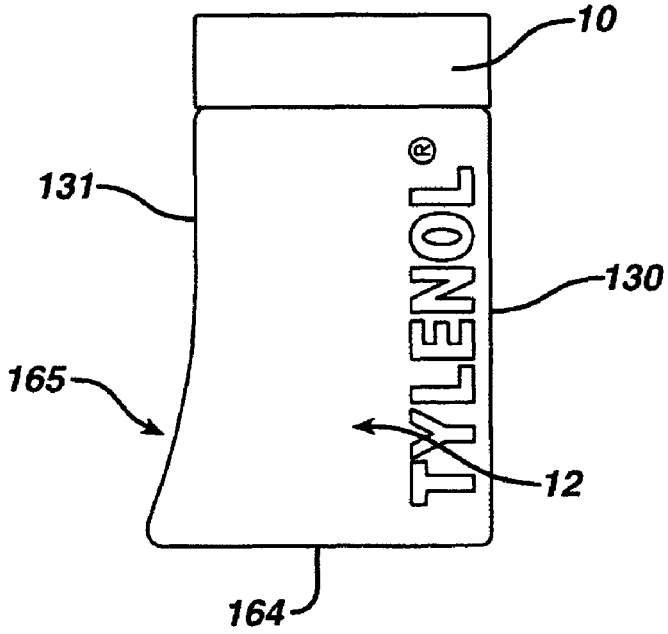
FIG. 29 is a perspective view of an alternative embodiment of a container.

In one embodiment as illustrated in FIG. 29, the container 12 may be asymmetrically shaped. In this embodiment, the container 12 may have a straight, substantially flat side 130, which facilitates the orientation of the container either on its on its side 130 or its bottom 164 when displayed on a shelf, and a rounded side 131 having a portion of concave curvature 165. Such containers 12' may have only one plane of symmetry, with the asymmetric side wall 131 being sized to easily fit into a human hand and optionally serving as an "easy-to-grip" feature.

Optionally, the bottom 164 of the container 12 may be configured in a manner that permits it to be stacked on top of the major upper surface 18 of an overcap 11 on another container. For example, the bottom 164 may have conformations (not shown), such as ridges and grooves, that removably engage with the similar conformations in the major upper surface 18 of an overcap 11.

Figure 5:
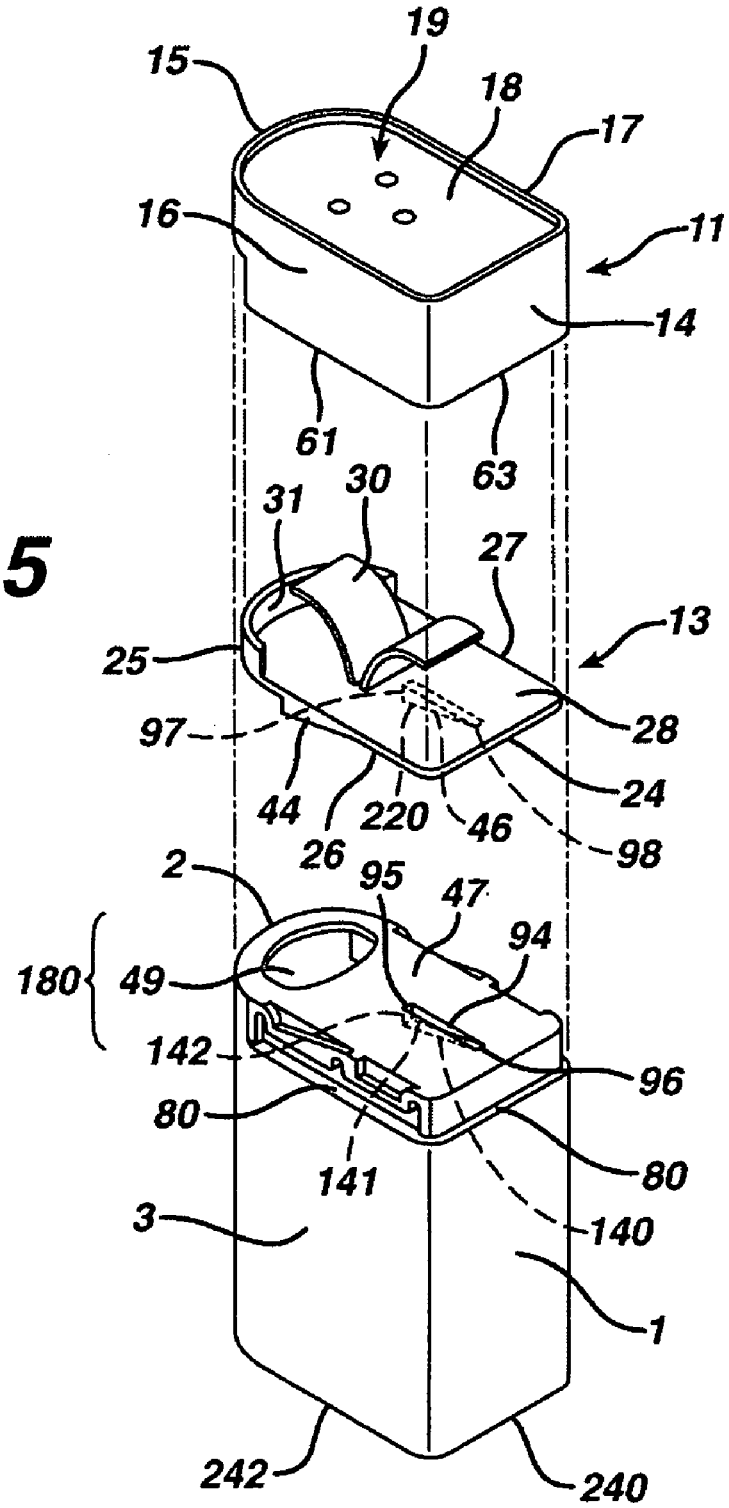
FIG. 5 is an exploded perspective view of the various components of a child-resistant closure of the present invention when placed on a container, wherein the closure is in the closed position.
Figure 8:
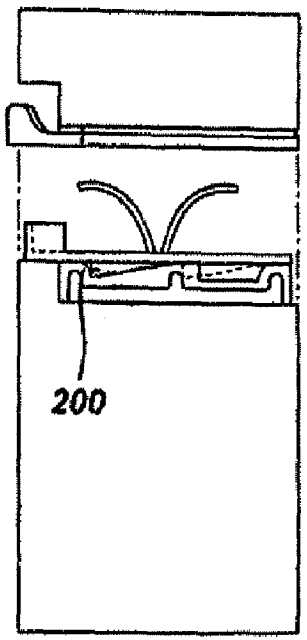
FIG. 8 is a left side elevational view of the closure and container of FIG. 6 showing the arrangement of the inner closure on the container.
Figure 7:
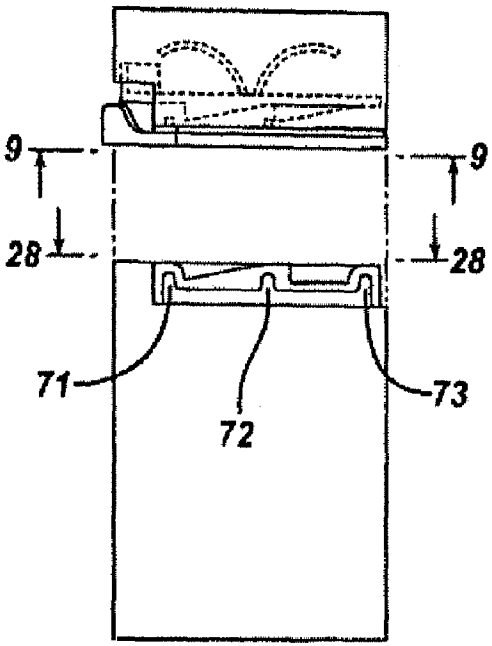
FIG. 7 is a left side elevational view of the closure and container of FIG. 6 showing the overcap having the inner closure (in phantom) assembled therein.
Figure 6:
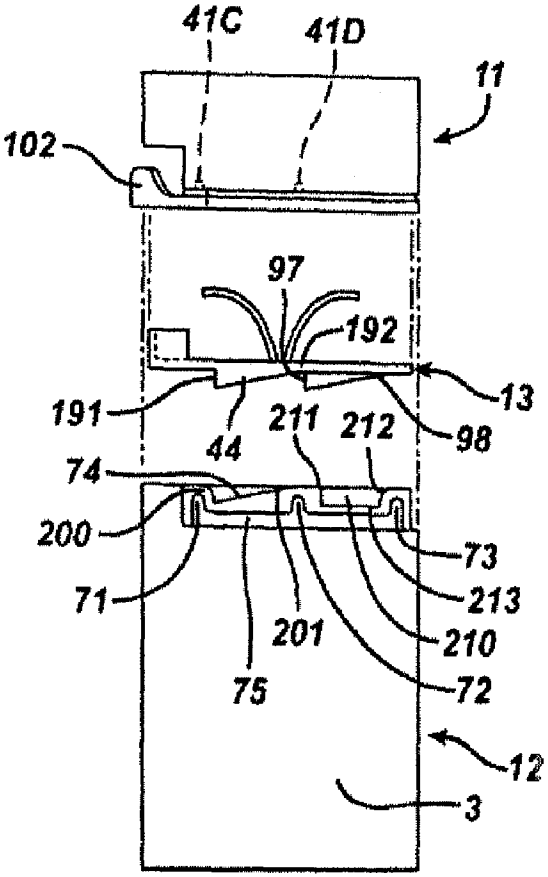
FIG. 6 is an exploded left side elevational view of the child-resistant closure and container of FIG. 5 with an optional tamper evident band, with the right side elevational view being substantially a mirror image thereof.
Figure 22:
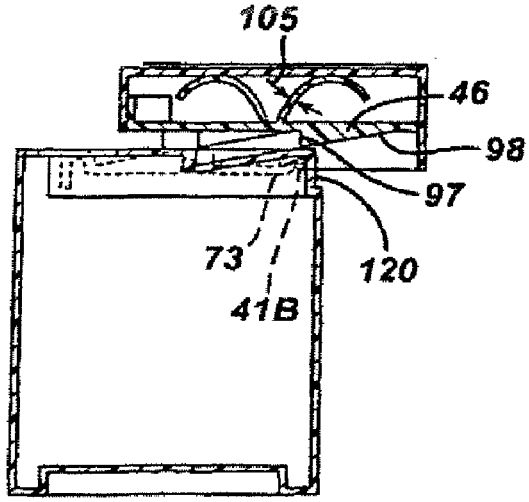
FIG. 22 is a cross-sectional view of the assembled child-resistant closure and container of FIG. 20 as taken along section line 22-22 of FIG. 20.
Figure 23:
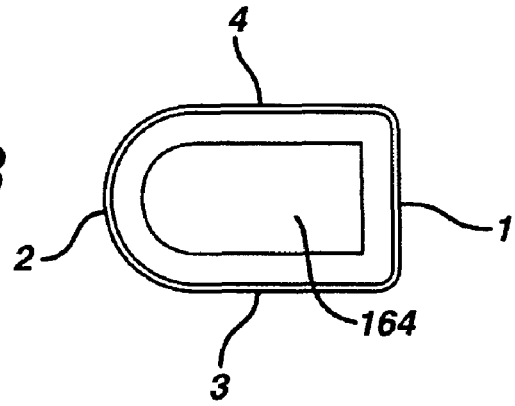
FIG. 23 is the bottom view of the container illustrated in FIG. 1.

As particularly shown in FIGS. 5, 22 and 23, the upper body portion 180 of the container 12 further has a fixed cover portion 47 that overlies the opening defined by the endwalls 1, 2 and sidewalls 3, 4. Proximate to the endwall 2 is a dispensing opening 49 that extends through the fixed cover portion 47. The shape and size of the dispensing opening 49 is not critical but should be of a sufficient size to permit the removal of the dosage forms from the container 12. Distal to the endwall 2 is an optional sliding slot 94 having a first end 95 and a second end 96 opposite thereto, which may optionally extend through the fixed cover portion 47 and is preferably compatible in shape, size, and location with the optional sliding bar 46 of the inner closure 13. As will be discussed in further detail later, in order to place the closure 10 into its operative open position, the closure 10 is moved in the substantially horizontal direction of arrow 92, and the sliding bar 46 of the inner closure 13 travels along the sliding slot 94 from the first end 95 of the sliding slot 94 to the second, opposed end 96. When the closure 10 is in its fully opened position, the first end 97 of the sliding bar 46 emerges from the sliding slot 94 in a location proximate to the upper container back edge 120 as illustrated in FIG. 22.

In an alternative embodiment, the sliding slot 94 may have a shape and length sufficient to permit the sliding bar 46 to slidably travel across the sliding slot 94 and remain substantially engaged within the sliding slot 94 when the closure 10 is in its fully opened position.

With reference to FIGS. 5, 6, 23 and 27, the sidewalls 3, 4 of the upper body portion 180 of the container 12 have at least two notches: a closing notch 71 and at least one open notch 72. In one embodiment, one of the sidewalls 3, 4 has both a closing notch 71 and an open notch 72, while in another embodiment one sidewall 3, may contain a closing notch 71 and the other sidewall 4 may contain an open notch 72. For the particular container illustrated in FIG. 6, which has an overcap 11 with two pairs of locking pins (that is, a pair of leading locking pins 41C and 41A, and a pair of trailing locking pins 41B and 41D), each respective sidewall 3, 4 of the container 12 may have a closing notch 71, 71', an open notch 72, 72', and a stopping notch 73, 73'. In embodiments where it is desirable to have a dispensing opening 49 of varied shape and/or size, the sidewalls 3, 4 may have one or more intermediate notches (not shown) between the closing notch 71 and the open notch 72. As illustrated in, for example, FIG. 6, the closing notch 71, the open notch 72, and the stopping notch 73 are interconnected by a tracking slot 75. Although not shown, the closing notch 71', the open notch 72', and the stopping notch 73' in sidewall 4 are also interconnected by a second tracking slot 75'.

Between the closing notch 71 and the opening notch 72 is an opening slot 74 that is compatible in shape and location with the guiding bar 44 of the inner closure 13. The guiding bar 44, 44' has a first end 191, 191' and a second opposed end 192, 192'. Similarly, between the closing notch 71' and the opening notch 72' in sidewall 4 is an opening slot 74' that is compatible in shape and location with the guiding bar 44 B of the inner closure 13.

Each opening slot 74, 74' has a first end 200, 200' and a second end 201, 201' opposite therefrom, and an opening slot bottom edge 203, 203' that may be substantially parallel, angled upwards, or angled downwards with respect to the fixed cover portion 47 of the container 12.

Between the opening notch 72 and the stopping notch 73 is an optional secondary opening slot 210 that is preferably compatible in shape and location with the guiding bar 44 of the inner closure 13 when the closure 10 is in the operative opening position. Similarly, between the opening notch 72' and the stopping notch 73' in sidewall 4 may be an additional, optional secondary opening slot 210' that is compatible in shape and location with the guiding bar 44 B of the inner closure 13 when the closure 10 is in the operative opening position.

Each secondary opening slot 210, 210' has a first end 211 and a second end 212 opposite therefrom, and a secondary opening slot bottom edge 213 that may be substantially parallel, angled upwards, or angled downwards with respect to the fixed cover portion 47 of the container 12.

Figure 13:
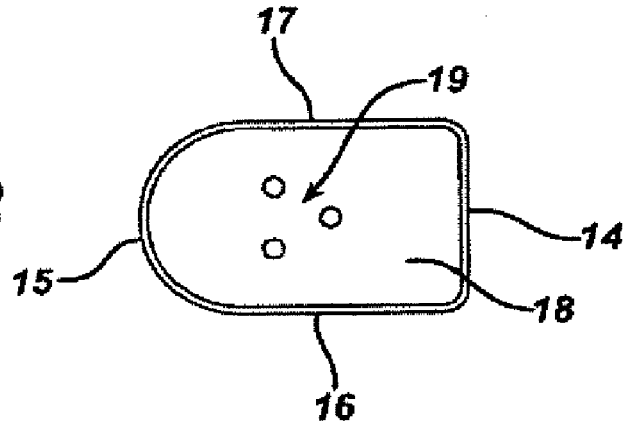
FIG. 13 is a top plan view of the assembled child-resistant closure and container of FIG. 3 after the tamper evident band has been removed as taken along view line 13-13 of FIG. 12.
Figure 14:
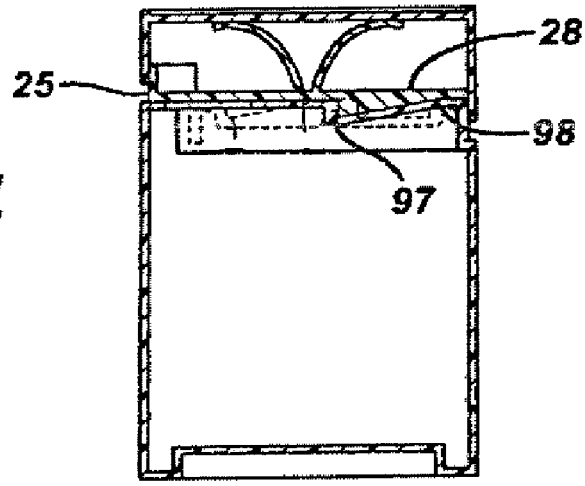
FIG. 14 is a cross-sectional view of the assembled child-resistant closure and container of FIG. 3 after the tamper evident band was removed, as taken along section line 14-14 of FIG. 12.

As illustrated in, for example, FIGS. 5 and 13, one embodiment of the child-resistant closure of the present invention comprises a two-part closure with an outer overcap 11 and an inner closure 13. The outer overcap 11 has a first end 14 and a second end 15 opposite thereto, and a first overcap side wall 16 and a second overcap sidewall 17 opposite thereto. The outer overcap 11 further has a major upper surface 18 which overlies the opening defined by the end walls, 14, 15 and the side walls, 16, 17.

For purposes particularly of opening the child-resistant closure 10, as described in greater detail hereafter, the major upper surface 18 of the outer overcap 11 may have a gripping means 19. As illustrated in FIG. 5, the gripping means 19 may be in the form of raised bumps arranged in an arrow formation. Advantageously, this formation also instructs the user of the direction in which the closure should be slid in order to open the closure 10; however, any arrangement for the bumps or the like is suitable. Any gripping means known in the art is suitable for use in this invention such as, for example, knerlments such as one or more raised bump(s) having any shape or one or more raised line(s); handle(s); knob(s) and the like. The gripping means 19 may be formed from the same material as the overcap 11, or they may be formed from a soft pliable material including but not limited to a thermoplastic elastomer, such as that available under the tradename, "DYNAFLEX TPE;" a thermoplastic rubber, such as that available under the tradename, "KRATON TPR," or other flexible rubber material. In embodiments wherein injection molding processing of the gripping means will not be used, the gripping means may also be formed from silicone.

The overcap 11 has at least one locking means such as a locking pin 41 that may be formed in the inner surface 42 of the overcap sidewalls 16, 17. The size and shape of the locking pin 41 is not critical, so long as it preferably is complimentary with the engaging means, e.g., closing notch 71, of the container 12. In one embodiment, the locking pin 41 terminates proximate to the bottom edge 61, 62 of the overcap sidewalls 16, 17 as illustrated in, for example, FIG. 25. Other suitable locking means include, but are not limited to hooks, balls, and the like.

Figure 9:
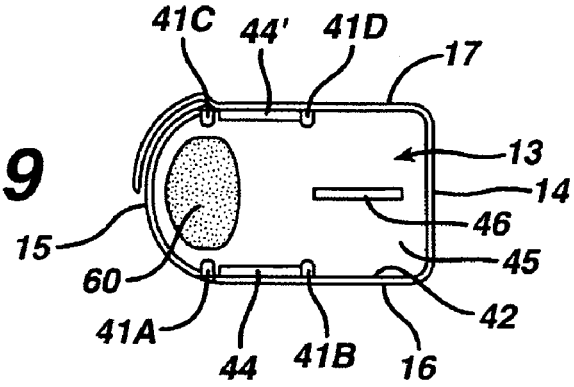
FIG. 9 is a bottom plan view of the inner closure as taken along view line 9-9 of FIG. 7.
Figure 10:
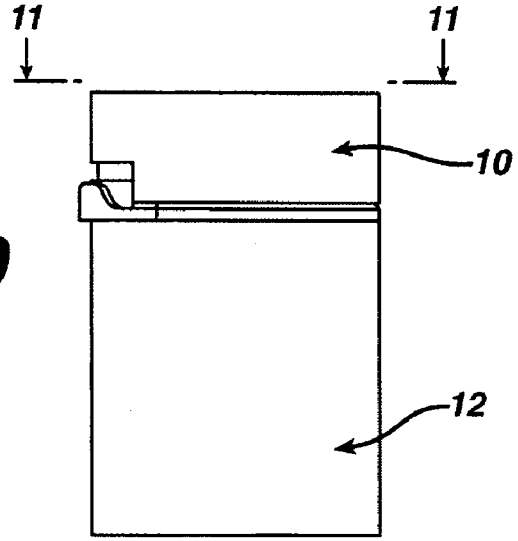
FIG. 10 is a left side elevational view of the assembled child-resistant closure and container of FIG. 6 with an optional tamper evident band, with the right side view being substantially a mirror image thereof.
Figure 11:
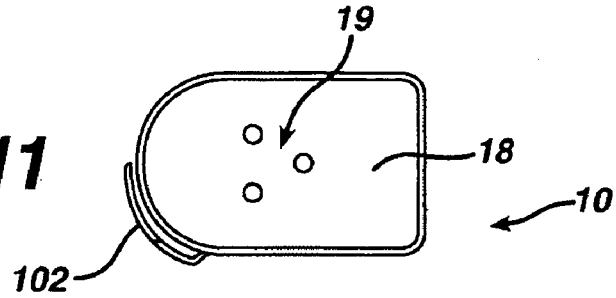
FIG. 11 is a top plan view of the child-resistant closure and container of FIG. 6.
Figure 12:
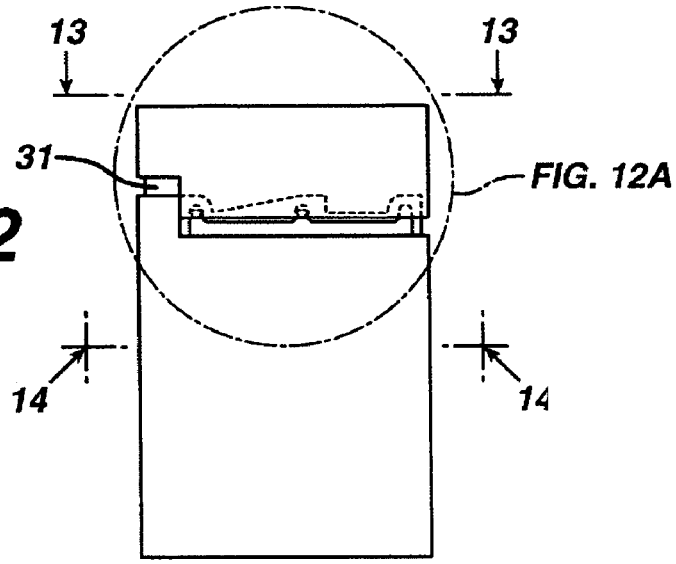
FIG. 12 is a left side elevational view of the assembled child-resistant closure and container of FIG. 3 after the tamper evident band has been removed, with the right side being substantially a mirror image thereof.
Figure 12A:
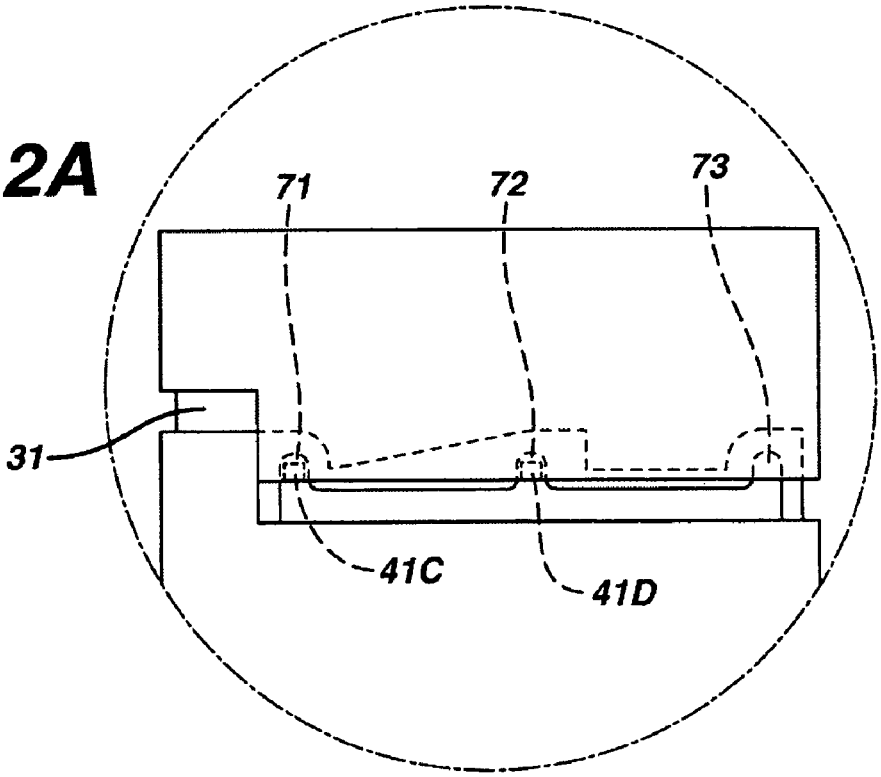
FIG. 12A is an enlarged view of the child resistant closure and container assembly of FIG. 3.
Figure 25:
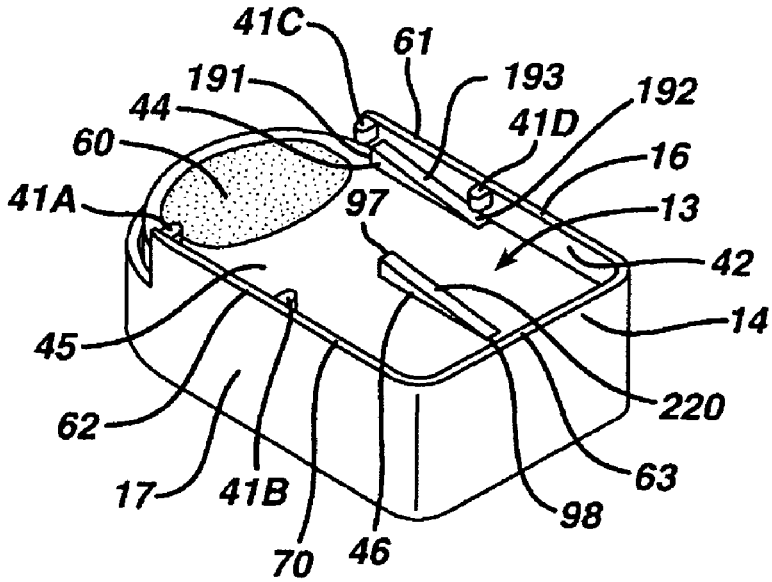
FIG. 25 is a perspective, bottom view of the inner closure assembled in the overcap.
Figure 26:
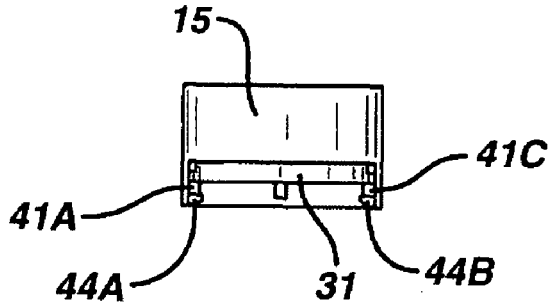
FIG. 26 is the front end view of the inner closure assembled in the overcap.
Figure 27:
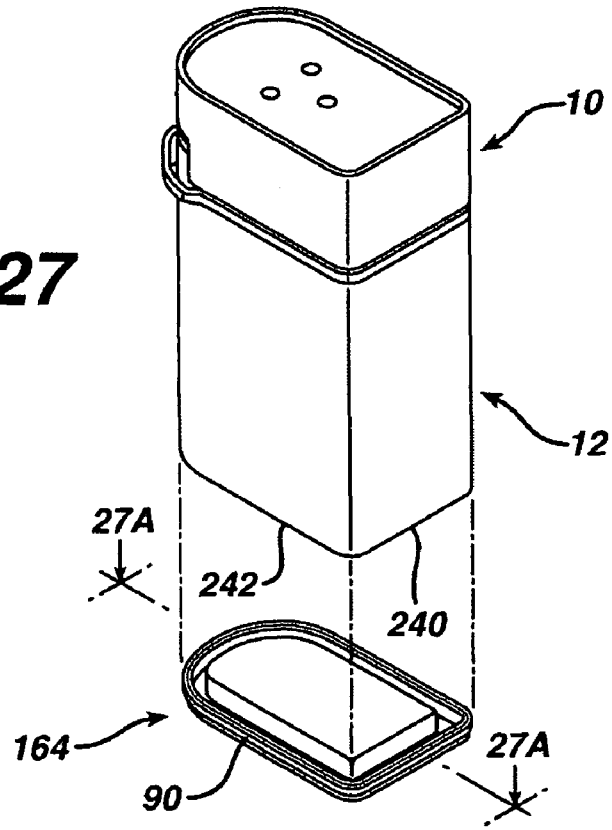
FIG. 27 is an exploded perspective view of a container and base plate.
Figure 27A:
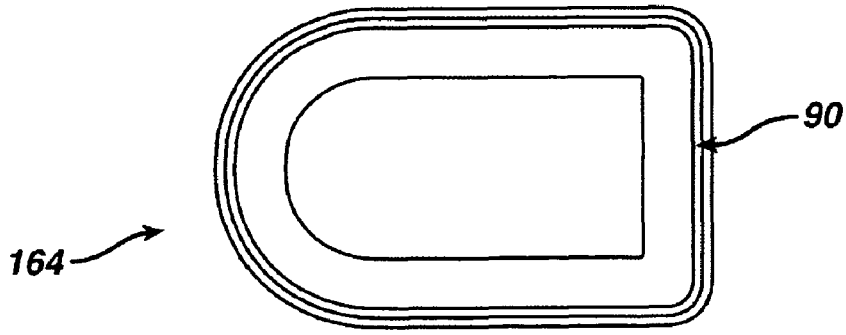
FIG. 27A is an enlarged plan view of the base plate of FIG. 27 as taken along section line 27A-27A.
Figure 28:
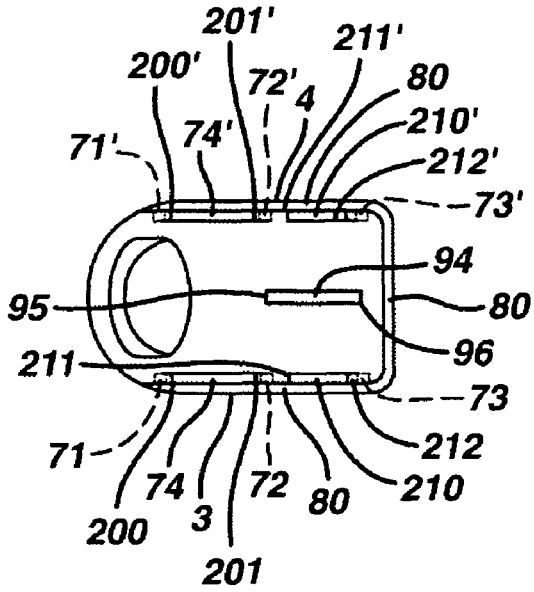
FIG. 28 is a plan view of the container.

In the embodiment illustrated in FIGS. 9 and 25, the overcap 11 has two pairs of locking pins 41A, 41B, 41C, and 41D, two of which extend from the inner surface 42 of the first overcap sidewall 16 and the other two of which extend from the inner surface 42 of the second overcap sidewall 17. Two of the locking pins 41C, 41 D terminate at the first bottom edge 61 of the first overcap sidewall 16, while the other two locking pins 41A, 41B terminate at the second bottom edge 62 of the second overcap sidewall 17. The number of locking pins in excess of one is not critical. In the embodiment particularly illustrated in FIG. 26, the locking pins 41 may also provide support to the inner closure 13 when set inside of the overcap 11. The operation and purpose of the locking pins 41 and the notches 71, 72, 73 are described in greater detail hereafter.

Figure 15:
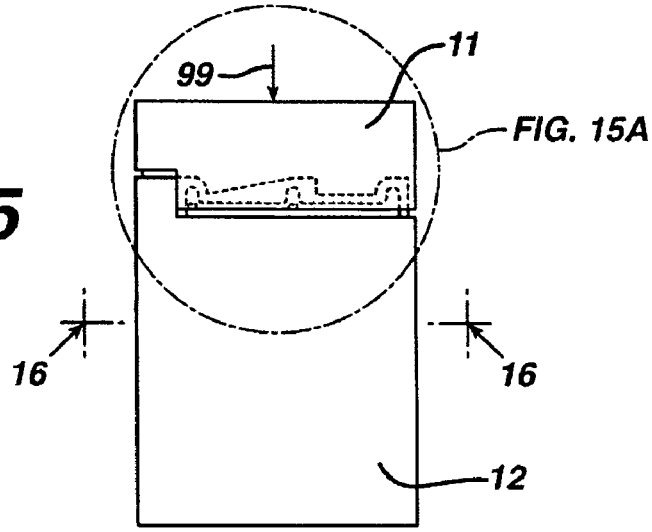
FIG. 15 is a side elevational view of the assembled child-resistant closure and container of FIG. 14 showing a progressive step during an opening operation of the closure.
Figure 15A:
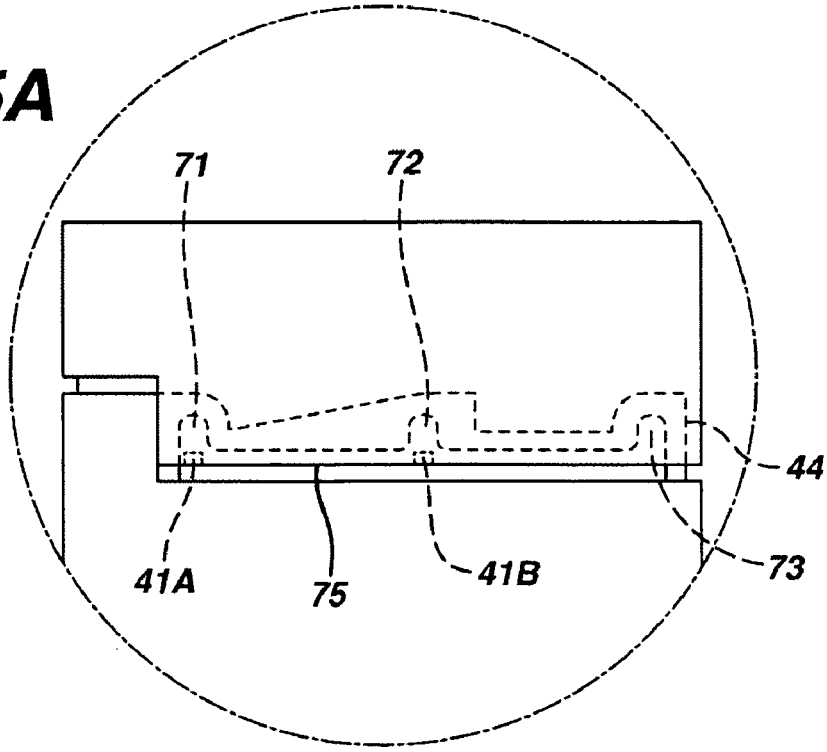

When the closure 10 is in the closed position as illustrated in FIG. 15, the locking pins 41A, 41B are engageably retained by the respective engaging means such as notches 71, 72 in the outer surface 43 of sidewall 3 of the container 12. The size and the shape of the engaging means are not critical, so long as they are capable of engaging the locking means, such as locking pins, and may include but not be limited to openings, slots, grooves, and the like.

As illustrated in, for example, FIGS. 5, 9, 14, and 24, the inner closure 13 has a first closure end 24 and a second closure end 25 opposite thereto, and a first closure side wall 26 and a second closure sidewall 27 opposite thereto. The inner closure 13 further has a first major surface 28 that is proximate to the lower surface 45 of the outer overcap 11 and a second major surface 50 opposite thereto.

Figure 16:
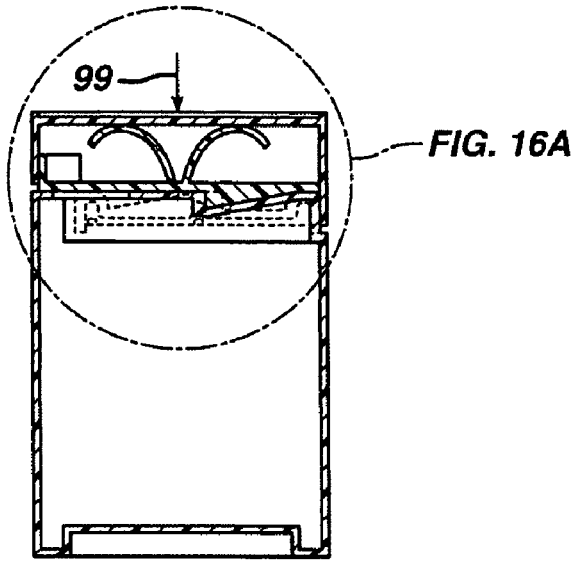
FIG. 16 is a cross-sectional view of the container of FIG. 15, as taken along section line 16-16 of FIG. 15.

A spring member 30 is shown generally at 30, and it is formed so as to be upstanding from the first major surface 28 of the inner closure 13. Although shown as a pair of arcuate projections, the shape is not critical so long as the spring member 30 is resilient enough to deflect when a downward force, as shown by the arrow in FIG. 16, is applied to the major upper surface 18 of the overcap 11 and preferably resume its approximate original shape when such force is removed. Suitable springs may be made from any known materials such as, for example, metal, plastic, rubber, elastomers, or any other material having such resilience properties. Examples of suitable spring members include a coiled spring, U-shaped spring, S-shaped spring, elliptic spring, bellow, or a molded spring such as one having at least one arcuate member comprised of a flexible material, the pair of which is illustrated in FIG. 5.

A stop wall is shown generally at 31, and it is formed so as to be upstanding from the second closure end 25 of the first major surface 28 of the inner closure 13.

Figure 24:
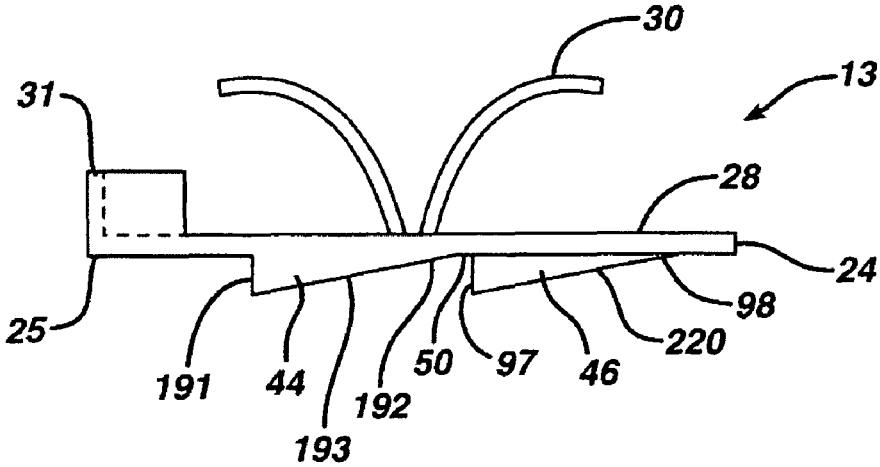
FIG. 24 is an enlarged left side view of the inner closure, with the right side view being substantially a mirror image thereof.

As illustrated in FIGS. 9 and 24, the inner closure 13 has at least one and preferably a pair of guiding bars 44, 44' that extend downwardly from the second major surface 50 of the inner closure 13, and are proximate to the front end or second inner closure end 25. The size, shape, and location of the guiding bar(s) 44, 44' are not critical, but are preferably complimentary with the opening slot(s) 74, 74' in the upper body portion 180 of the container 12.

Each guiding bar 44, 44' has a first end 191 and a second end 192 opposite therefrom, and a guiding bar bottom edge 193 that may be substantially parallel, angled upwards, or angled downwards with respect to the first major surface 28 of the inner closure 13.

The inner closure 13 may optionally have at least one sliding bar 46 that extends downwardly from the second major surface 50 of the inner closure 13 and preferably is located distally from the guiding bar 44, 44'. The size, shape and location of the sliding bar 46 is not critical so long as it is complimentary with the sliding slot 94 in the fixed cover portion 47 of the container 12.

The sliding bar 46 has a first end 97 and a second end 98 opposite therefrom, and a sliding bar bottom edge 220 that may be substantially parallel, angled upwards, or angled downwards with respect to the first major surface 28 of the inner closure 13.

As illustrated in FIG. 9, the inner closure 13 further may have an optional gasket 60 proximate to the second end 15 of the lower surface 45. The shape and size of the gasket 60 are not critical, but preferably should be somewhat larger in surface area than that of the dispensing opening 49 of the container 12. Advantageously, the incorporation of such a gasket 60 minimizes moisture penetration into the container 12, and is beneficial in embodiments wherein a hermetic seal is of importance. The gasket 60 is typically made via two-shot injection molding using, for example, the aforementioned soft pliable materials. Alternatively, the gasket 60 may be spray coated onto the closure 13 via methods well known in the art. In order to minimize the formation of cracks between the gasket 60 and the closure 13, the gasket 60 may first be injection molded, followed by the subsequent injection molding of the remaining closure 13.

The inner closure 13 may be frictionally fit within the outer overcap 11 to form a two-piece assembly. Alternatively, the inner closure 13 may be attached to the overcap 11 via a hinge (not shown) between the first closure end 24 and the bottom edge 63 of the first end wall 14 of the outer overcap 11. Typically, the hinge is a living hinge, whereby the inner closure 13 is adjoined proximately to the first end wall 14 of the overcap 11. However, the hinge may be formed as a two-piece bolt-type or piano-type hinge, where two mating hinge halves are hingingly secured together by a hinge pin. In this case, the hinge pin is put into place and upset at both ends so as to make it impossible to be removed, thus resulting in a unitary structure for the child-resistant closure 10. It has been noted that one embodiment of the present invention particularly provides a unitary child-resistant closure for tablet containers. By "unitary", it is meant that the child-resistant closure may be molded as a single piece, using injection molding techniques; or that the child-resistant closure may be constructed and assembled in such a manner that, once it is assembled, it is not ordinarily possible to be disassembled. Thus, in any and all events, the child-resistant closure of this embodiment will exhibit the characteristics of being a unitary or one-piece whole structure.

Thus, it can be seen from FIGS. 5-8, and 12-16 for example, that the closure 10 has an operative closed position as shown in those Figures. Moreover, as seen particularly from FIG. 15, the moveable overcap is frictionally fit or snap fit onto the container 12 such that the pair of inwardly projecting leading locking pins 41A, 41C are engaged in the pair of closing notches 71, 71', respectively, and the pair of inwardly projecting trailing locking pins 41B, 41D are engaged in the pair of open notches 72, 72', respectively. To assist in the action of the child resistant closure of the present invention, when the moveable closure 10 is in its operative closure position, there will be an interference engagement between the closing notches 71, 71' and the locking pins 41A, C, as well as another interference engagement between the trailing locking pins 41B,D and the open notches 72. Additional engaging means such as ridges 80 may be formed in at least the end wall 1 or at least one of the sidewalls 3,4 of the container 12. The ridge(s) should compliment the shape, size, and location of at least the bottom edge 63 of the first end 14, the second end 15, and/or at least one of the bottom edges 61, 62 of the sidewalls 16, 17 of the overcap. That engagement may be an enhancement to both opening and closing the child-resistant closure of the present invention, so as to gain or preclude access to the prescribed medication in the container 12, as discussed hereafter.

When the moveable overcap 11 is in its operative closure position, the dispensing opening 49, which is less than about 75% (e.g., less than about 50% or less than about 33% or less than about 25%) of the opening defined by the end walls 1, 2, and side walls 3, 4 in the of the container 12, is covered.

It has been noted above that the child-resistant closure of the present invention is intended for use with a container 12 that may have any cross-sectional shape, but preferably the shape or "footprint" of the open mouth formed along the upper body portion 180 compliments the shape formed by the bottom edges 61, 62, 63 of the overcap.

The operation of the child-resistant closure 10, in association with a container 12, will now be discussed. First, it will be assumed that the requisite number of dosage forms have been inserted into a container 12 having a suitable volume, and a child-resistant closure having an appropriate size and shape 10 has been placed over the container 12. In one embodiment, the container may first be formed without a base plate 164, then filled with dosage forms through the lower opening of the container 12 formed by the bottom edges 240, 241 of the endwalls 1, 2 and the bottom edges 242, 243 of the side walls 3, 4. After the container 12 contains the desired amount of dosage forms, the base plate 164 may be attached to the container 12 along the bottom edges 240, 241, 242, 243 via any means known in the art such as, for example, induction sealing, sonic welding, microwaving, friction-fitting, heat welding, or adhesion. In embodiments wherein having a hermetic seal is of particular importance, a gasket 90 may first be placed on the upper surface 91 of the base plate 164. The gasket may be formed from any material, such as for example the aforementioned soft pliable materials, and should be of a sufficient size and shape to be substantially covered by the bottom edges 240, 241, 242, 243 of the sidewalls 3, 4 and endwalls 1, 2.

In any event, the manipulation and physical movements that are required to open the child-resistant closure 10 are particularly revealed in FIGS. 15 through 22. From FIG. 12 it will be seen that the closure 10 is in its closed operative position so that, in the first instance, there is an engagement of the leading locking pins 41C, 41A with the closing notches 71, 71', as well as an engagement of the trailing locking pins 41D, 41B with the open notches 72, 72'. In this closed position, the guiding bars 44, 44' which may be in the form of ramps, are slidingly engaged with the opening slots 74, 74', which may be in the form of inverse ramps.

Figure 21:
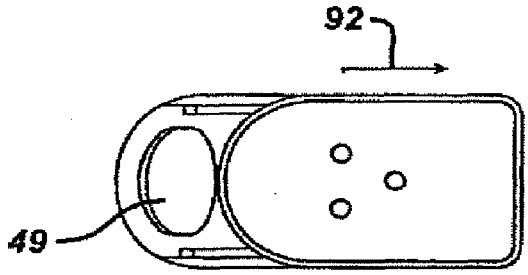
FIG. 21 is a top plan view of the assembled child-resistant closure and container of FIG. 20 as taken along view line 21-21.

It will be seen in FIG. 21 that, when the closure 10 is opened, there is an essentially unrestricted access through the dispensing opening 49 to the interior of the container 12.

Figure 16A:
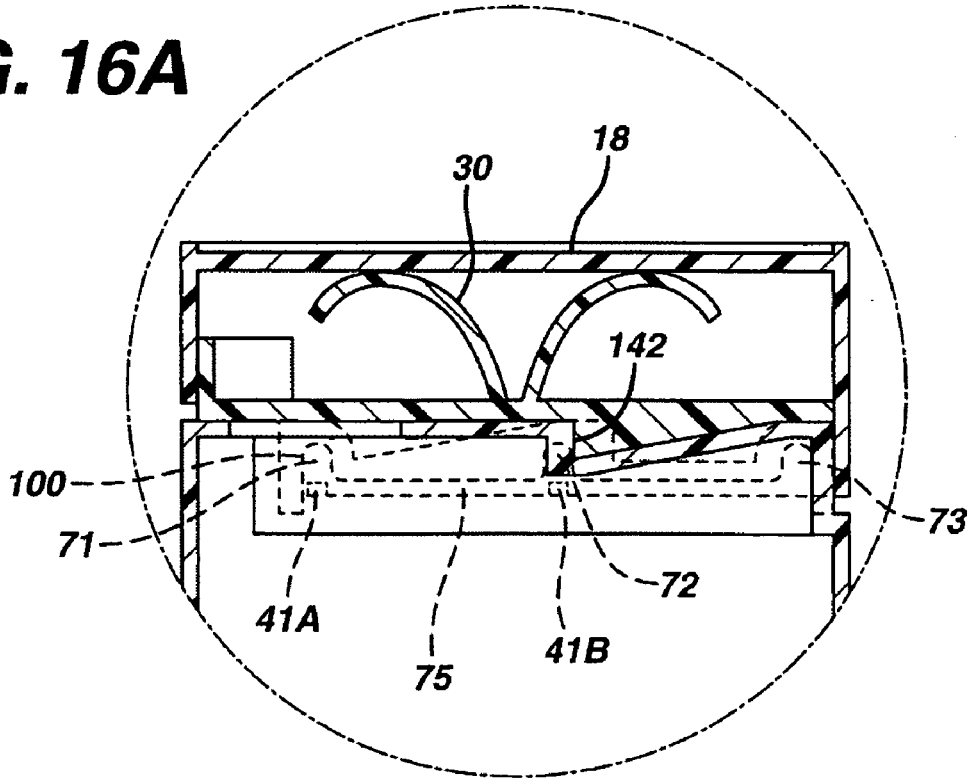

It will be seen from an examination of FIGS. 16-22 that, pushing down the overcap 11 in the direction of arrow 92, will cause the closure 11 to recede somewhat downwardly in the same direction. This, in turn, will have the effect of compressing the spring member 30, as again will be noted from an examination of, for example, FIGS. 16A and 19. The leading locking pins 41A, 41C and the trailing locking pins 41B, 41D will also disengage from the closing notches 71, 71' and the open notches 72, 72' and enter the tracking slots 75, 75'.

Figure 17:
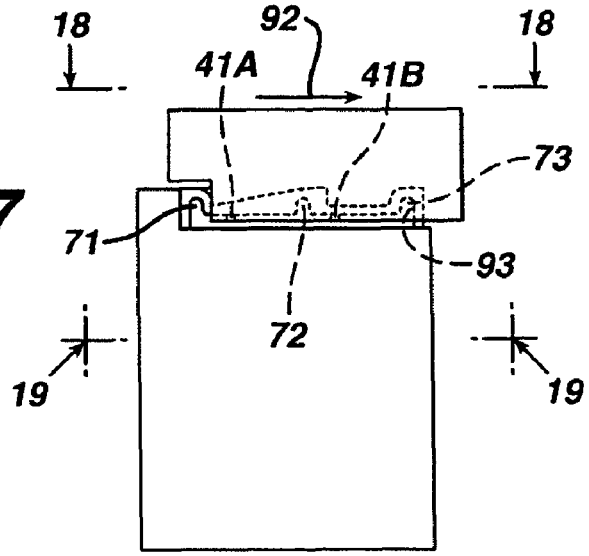
FIG. 17 is a left side elevational view of the assembled child-resistant closure and container of FIG. 15 showing a further progressive step during an opening operation of the child-resistant closure, with the right side view being substantially a mirror image thereof.
Figure 18:
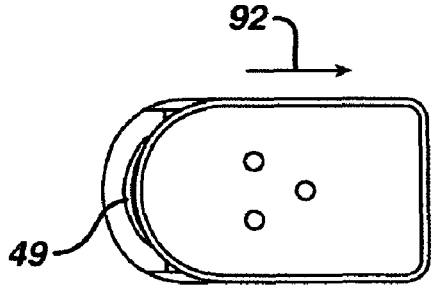
FIG. 18 is a top plan view of the assembled child-resistant closure and container of FIG. 17 as taken along view line 18-18 of FIG. 17.
Figure 19:
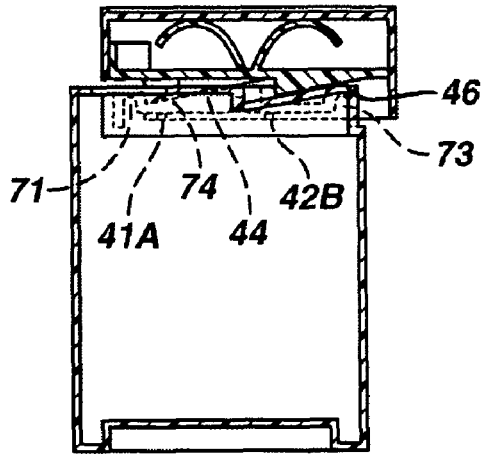
FIG. 19 is a cross-sectional view of the assembled child-resistant closure and container of FIG. 17 as taken along section line 19-19 of FIG. 17.

While maintaining a downward force, the overcap 11 may then be slid in the direction of arrow 92 as particularly illustrated in FIGS. 17-19. In this embodiment, the leading locking pins 41A, 41C and the trailing locking pins 41B, 41D remain disengaged from the closing notches 71, 71' and the open notches 72, 72', respectively, and continue to move slidably along the sidewalls 3, 4 in the tracking slots 75, 75'. The tracking slots 75, 75' are preferably substantially horizontal as illustrated in FIG. 16, but they may also be angled upward towards the fixed cover portion 47 or downward towards the base plate 48 of the container 12. As particularly illustrated in FIG. 18, the dispensing opening becomes visible as the overcap 11 is permitted to slide in the direction of arrow 92.

One purpose of the guiding bars 44, 44' of the inner closure 13 and the opening slots 74, 74' of the container 12 is to create a slidable surface or surfaces therebetween to assure a smooth transition of the position of the closure 11 from the closed position shown in, for example, FIG. 16 ultimately to the open position shown in FIG. 22. The interaction between the guiding bars 44, 44' of the inner closure 13 and the opening slots 74, 74' of the container 12 is illustrated in FIG. 19. To further keep the closure properly aligned during the opening operation, the sliding bar 46 also may remain engaged in the sliding slot 94 of the container and be slid therein from the first end 95 to the second end 96 of the sliding slot 94.

Figure 20:
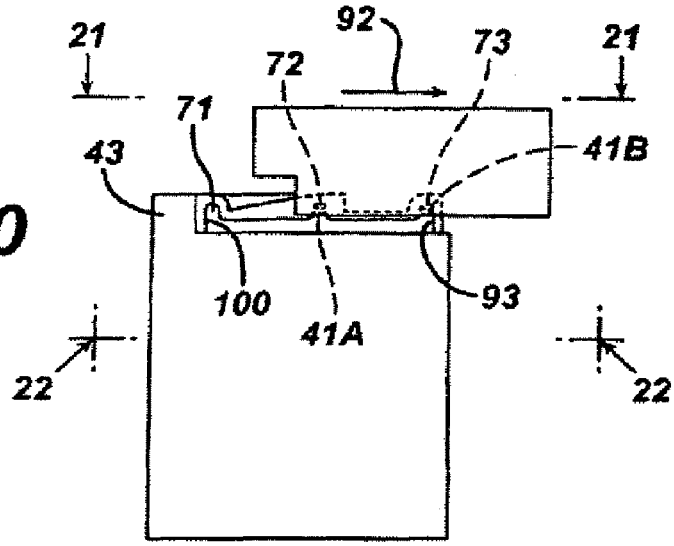
FIG. 20 is a side elevational view of the assembled child-resistant closure and container of FIG. 15 showing the closure in a fully opened position.

It will be noted from FIGS. 20-22 that the closure may be slid in the direction of arrow 92 until the point that the trailing locking pin(s) 41B, 41 D contact the stopping notch walls 93, 93'. At this point, the downward force on the closure 10 may be removed, and the resiliency of the spring member 30 will urge the closure 10 in the upward direction. As the closure 11 moves upwardly, the leading locking pins 41A, 41C become engaged in the open notches 72, 72', respectively, and the trailing locking pins 41B, 41D become engaged in the stopping notches 73, 73' as illustrated in FIG. 20. In a preferred embodiment, the sliding bar 46 also becomes substantially disengaged from the sliding slot 94 in the container 12. That is, the first end of the 97 of the sliding bar 46 is near or beyond the second end 96 of the sliding slot 94. As a result, the dispensing opening 49 is visible in an amount sufficient to permit the removal of the dosage forms from the container 12.

In another embodiment, the closure 13 does not have a sliding bar 46, and the container 12 does not have a sliding slot 94.

In embodiments wherein the container 12 has an optional sliding slot 94, the sliding slot 94 may be in the form of either an opening through the fixed cover portion 47, or it may have at least one endwall 142,142' two sliding slot sidewalls 141, 141', and a sliding slot bottom edge 140. The sliding slot bottom edge 140 may either be substantially parallel with the fixed cover portion 47 (not shown), substantially downward towards the second end 96 (not shown), or preferably substantially angled upward towards the second end 96 as shown in FIG. 5. Advantageously, the sliding slot 94 contributes to the stabilization of the closure during opening and closing operations. In embodiments wherein moisture sensitivity with in the container 12 is of importance, use of sliding slots 94 with sliding slot sidewalls 141, 141' is preferred.

The strength of the spring member 30 may be varied from one configuration of child-resistant closure to another, by, for example, adjusting the width, length, and/or in some instances, the thickness 105 of the spring member 30.

When the moveable closure 10 is in the fully open position, the sliding bars 44, 44' become engaged in the secondary opening slots 210, 210' such that the first end 191 of the guiding bar 44, 44' contacts the first end 211 of the secondary opening slot(s) 210, 210'.

To close the child-resistant closure so that the closure 10 assumes its inoperative closed position, is more or less a reversal of the manipulation required to open the child-resistant closure. Thus, reviewing FIGS. 16 and 20-22, it will be seen that first the closure 10 must be moved in a direction towards the container, i.e., in the direction of arrow 99, so that the leading locking pins 41A, 41C clear and become disengaged with the open notches 72, 72', respectively, and the trailing locking pins 41B, 41D clear and become disengaged with the stopping notches 73, 73'. That downward force is easily accomplished, particularly by engaging the gripping means 19 with the thumb, finger(s), or palm.

However, it is not enough that the closure 10 be moved in a direction towards the container 12, because unless it is also slid in the direction opposite that shown by arrow 92 so as to assume a position such as that shown in FIGS. 15 and 16, the action of the spring member 30 will merely cause the closure 10 to re-assume an open position such as that shown in FIGS. 20-22. In other words, a very deliberate downward-and-slide action is required.

After the leading locking pins 41A, 41C clear the open notches 72, 72', respectively, and the trailing locking pins 41B, 41D clear the stopping notches 73, 73', the closure 11 may then be slid along the tracking slots 75, 75' in the direction opposite to arrow 92 while maintaining a downward force on the closure until the leading locking pins 41A, 41C contact the closing notch wall 100, 100'. At this point, the downward force on the closure 10 may be removed, and the resilient action of the spring member 30 will urge the closure 10 in the upward direction. As the closure 11 moves upwardly, the leading locking pins 41A, 41C become engaged in the closing notches 71, 71', respectively, and the trailing locking pins 41B, 41D become engaged in the open notches 72, 72' as illustrated in FIGS. 12-16. The sliding bar 46 also becomes substantially engaged with the sliding slot 94 in the container 12. That is, the first end of the 97 of the sliding slot 46 is near or at the first end 95 of the sliding slot 94. As a result, the dispensing opening 49 is no longer visible in an amount sufficient to permit the removal of the dosage forms from the container 12.

It will be apparent to persons skilled in the art that numerous modifications may be made to the closure and the container described in this specification without departing form the scope of the invention as earlier defined. The closure, for instance, may be provided with a tamper evident feature adapted to provide an indication of removal or attempted removal of the closure from a container. Examples of suitable tamper evident features include, but are not limited to "skip-pattern" bands, which could extend around a portion or all of the first end 14, second end 15, and sidewalls 16, 17 of the overcap 11 and/or around a portion or all of the first end 1, second end 2, and side walls 3, 4, of the container by connection through plurality of frangible bridges.

Alternatively, in the embodiment illustrated in FIG. 2, a removable tamper evident band 300 may be formed by extending the bottom edge(s) 61, 62, 63 of overcap sidewalls and/or endwalls to form a secondary lower edge 125 of the overcap downward so that it rests in the ridge 80, and by reducing the thickness 124 of sidewalls and/or end walls of the overcap 11 along the upper band edge 122. In order to open the container, the sealing flange 102 may be pulled in the direction of arrow 103 such that is disengages with the remainder of the overcap along the upper band edge 122. After the tamper evident band 300 is removed, a tamper evident gap 110 is created as shown in FIG. 3. The tamper evident gap 110 also provides the closure 10 with the vertical space necessary for it to be pushed in a downward direction, causing the disengagement of the leading locking pin(s) 41C and trailing locking pin(s) 41 B,D as aforementioned.

In yet another embodiment (not shown), a label may be placed on both the container 12 and the child-resistant closure 10 to form a tamper indicator. If the label has been broken by a sliding action of the closure 10, it would be very evident.

Figure 30:
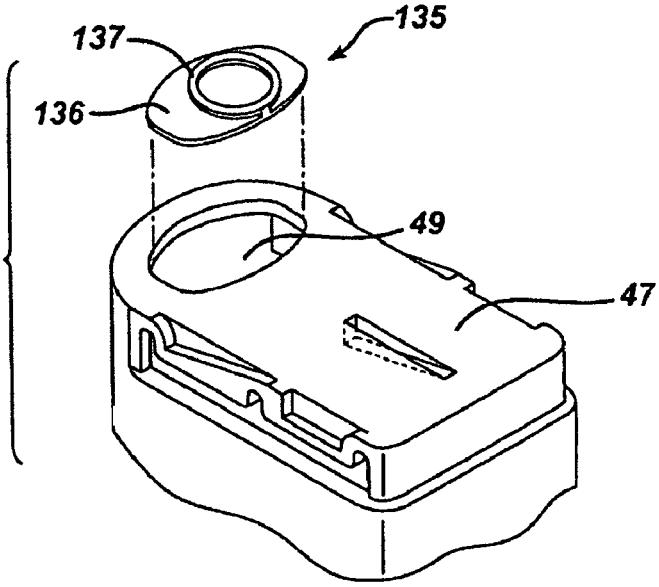
FIG. 30 is an exploded perspective view of a second tamper evident feature on the dispensing opening of the container illustrated in FIG. 1.
Figure 31:
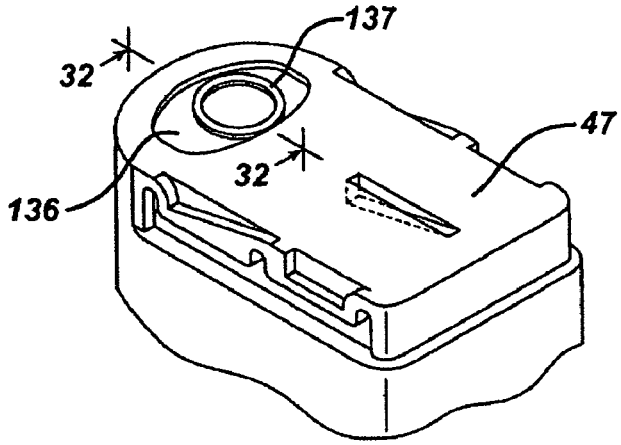
FIG. 31 is a perspective view of the second tamper evident features assembled on the dispensing opening of the container illustrated in FIG. 1.
Figure 32:
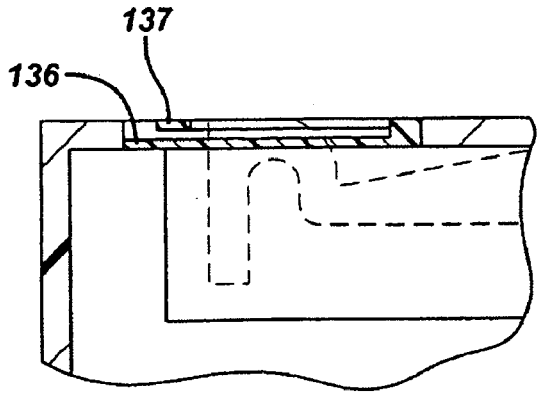
FIG. 32 is a sectional view of the second tamper evident feature on the dispensing opening as taken along view line 32-32 of FIG. 31.

As illustrated in FIGS. 30-32, the dispensing opening 49 may be covered with a second tamper evident means 135 such as a cover or plug 136 with an opening means 137 such as a ring, tab, or the like.

The tamper evident features provides an indication of the opening or attempted opening of the closure and thus serves to ensure the integrity of the container's contents until ultimate use or consumption by the consumer of the container's contents.

A particular advantage to the patient from the use of non-cylindrical containers, in general, is the fact that, for example, a rectangular container may fit more easily into a pocket or purse. Moreover, it has been noted above that the use of rectangular containers provides a greater packing density and therefore a better storage efficiency, either on the store shelf or in the medicine cabinet, than the use of cylindrical pharmaceutical containers.

The child-resistant closure of the present invention is typically injection molded using polypropylene which provides for a pharmaceutically acceptable material, and one which will permit formation of a living hinge if desired to keep with one embodiment of the present invention. High density polyethylene is particularly suitable in embodiments wherein moisture protection is desired. Polypropylene is particularly suitable in embodiments wherein clarity is desired. Also, polypropylene has sufficient elastic memory that the spring action of the spring member 30 may be assured. Moreover, polypropylene may be molded with sufficient detail that a two-part closure may be accurately molded, if necessary or if required.

Typically, containers 12 are formed from polyethylene, crystal-polystyrene, or mixtures of polypropylene, in much the same manner and using the same materials as conventional cylindrical tablet containers.

In embodiments using the tamper evident band, it is recommended that both the container and the overcap are made using polyethylene.

In one embodiment, a dosage form, such as a pharmaceutical sold "over the counter," i.e., e.g. without a prescription ("OTC dosage form"), may be packaged in a container 12' comprised of a translucent, transparent, or opaque material. Optionally, this filled container 12' may be sold without an outside secondary package, e.g. carton, which would then enable a consumer to view the dosage forms inside of the container 12' prior to purchase.

Advantageously, the closure of the present invention cannot be easily removed from the container, which would not only reduce the possibility of having the closure incorrectly secured or loosely secured onto the wrong container, but also reduce the possibility that children may place a separated cap into their mouth. The closure of the present invention also only provides an effective child-resistant feature, while being readily openable by an adult having compromised hand strength. In addition, the closure remains in substantially one plane during opening and closing operations, which is less intrusive that many of the multi-planar closures of the prior art. Further, the closure is suitable for use in containers having other than cylindrical shapes.

There has been described a child-resistant closure, and the combination of a child-resistant closure together with a dosage form container, all in keeping with the general principles of the present invention as defined as described above. It will be understood, of course, that variations may be made to any configuration in keeping with the present invention, and modifications may be made to specific features of the child-resistant closure of the present invention, without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. In addition, any number followed by an apostrophe, "'", shall refer to the same element as it would appear at another location of the product.

Moreover, the word "substantially" when used with an adjective or adverb is intended to enhance the scope of the particular characteristic; e.g., substantially rectangular is intended to mean rectangular, nearly rectangular, and/or exhibiting characteristics associated with a rectangular configuration.

What is claimed is:

1. A method of selling dosage forms without a prescription, said method comprising:

packaging a plurality of same dosage forms in a container having a bottom shaped and configured to stably support the container on a retail display shelf, a dispensing opening opposite the bottom, a first side wall extending between the bottom and the dispensing opening and shaped and configured to stably support the container on the retail shelf with the container in a sideway orientation, and at least one curved side wall extending between the bottom and the dispensing opening, the container being sized, shaped, and dimensioned for gripping in a user's hand for dispensing one or more dosage forms through the dispensing opening, and the at least one curved side wall being sized to fit into a human hand to facilitate holding and gripping of the container in the user's hand to dispense the one or more dosage forms from the container;

displaying the plurality of the same dosage forms on the retail display shelf for sale to a consumer in the container without secondary packaging, the container being comprised of a material that permits the user to see the dosage forms through the container while on the retail display shelf; and displaying the container on the retail display shelf supported on the first side wall of the container.

2. The method of claim 1, wherein the container is comprised of a material that is translucent or transparent.

3. The method of claim 2, wherein the container has only one plane of symmetry.

4. The method of claim 2, wherein:

the first side wall and the curved side wall are opposite each other;

the container further includes first and second opposed side walls, each of the first and second opposed side walls being positioned between the first side wall and the curved side wall; and at least one of the side walls has a portion of concave curvature.

5. The method of claim 1, wherein the container has only one plane of symmetry.

6. The method of claim 1, wherein:

the first side wall and the curved side wall are opposite each other;

the container further includes first and second opposed side walls, each of the first and second opposed side walls being positioned between the first side wall and the curved side wall; and at least one of the side walls has a portion of concave curvature.

7. A method of selling dosage forms without a prescription, said method comprising:

displaying said dosage forms in a container having a dispensing opening closed with a child resistant closure, a bottom opposite the dispensing opening and configured to stably support the container, and at least one side wall extending between the dispensing opening and the bottom and configured to stably support the container;

wherein:

the container has a curved portion along a side extending between the dispensing opening and the bottom sized to fit into a human hand to facilitate gripping of the container to dispense at least one dosage form; and the container is configured to be laid on a retail display shelf on either the bottom, for sale to a consumer in an upright orientation with the dispensing opening extending upwardly, or on the side configured to stably support the container, for sale to a consumer in a sideway orientation with the dispensing opening positioned sideways.

8. The method of claim 7, wherein the container is comprised of a material that permits a user to see the dosage forms through the container.

9. The method of claim 8, wherein the container is displayed without an outer secondary package.

10. The method of claim 7, wherein the container is displayed without an outer secondary package.

11. The method of claim 10, wherein the container has only one plane of symmetry.

12. The method of claim 7, wherein the container has only one plane of symmetry.

13. The method of claim 1, wherein:

the first side wall and the curved side wall are opposite each other;

the container further includes first and second opposed side walls, each of the first and second opposed side walls being positioned between the first side wall and the curved side wall;

at least one of the side walls has a portion of concave curvature; and the container is displayed by laying the container on one of its side walls.

14. The method of claim 2, wherein:

the first side wall and the curved side wall are opposite each other;

the container further includes opposed first and second side walls, each of the opposed first and second side walls being positioned between the first side wall and the curved side wall;

at least one of the side walls has a portion of concave curvature; and the container is displayed by laying the container on one of its side walls.

15. The method of claim 7, wherein:

the container has two opposed side walls, a front wall, and an opposed back wall; and at least one of the side walls has a portion of concave curvature.

16. The method of claim 10, wherein:

the container has two opposed side walls, a front wall, and an opposed back wall; and at least one of the side walls has a portion of concave curvature.

17. The method of claim 7, wherein:

the container has, extending between the dispensing opening and the bottom, a bottom, two opposed side walls, a front wall, and an opposed back wall; and at least one of the side walls is configured to facilitate gripping of the container.

18. The method of claim 10, wherein:

the container has, extending between the dispensing opening and the bottom, a bottom, two opposed side walls, a front wall, and an opposed back wall; and at least one of the side walls is configured to facilitate gripping of the container.

19. The method of claim 1, wherein branding information is formed on a wall of the container.

20. The method of claim 7, wherein branding information is formed on a wall of the container.

* * * * *